US007528353B2

(12) United States Patent
Risman et al.

(10) Patent No.: US 7,528,353 B2
(45) Date of Patent: May 5, 2009

(54) MICROWAVE HEATING DEVICE

(75) Inventors: Per Olof G. Risman, Härryda (SE); Magnus Fagrell, Uppsala (SE); Fredrik Stillesjö, Uppsala (SE)

(73) Assignee: Biotage AB, Uppsala (SE)

( * ) Notice: Subject to any disclaimer, the term of this patent is extended or adjusted under 35 U.S.C. 154(b) by 66 days.

(21) Appl. No.: 10/556,505

(22) PCT Filed: Apr. 30, 2004

(86) PCT No.: PCT/SE2004/000669

§ 371 (c)(1),
(2), (4) Date: Nov. 14, 2005

(87) PCT Pub. No.: WO2004/105443

PCT Pub. Date: Dec. 2, 2004

(65) Prior Publication Data

US 2006/0196871 A1 Sep. 7, 2006

(30) Foreign Application Priority Data

May 20, 2003 (SE) ..... 0301488
Aug. 28, 2003 (EP) ..... 03102665

(51) Int. Cl.
*H05B 6/78* (2006.01)

(52) U.S. Cl. ..... 219/695; 219/746

(58) Field of Classification Search ..... 219/696, 219/699, 697, 692, 691, 690, 745, 746, 738, 219/750, 693, 695, 121.43, 121.59; 156/345.48, 156/345.54; 118/723 I, 723 E; 343/786
See application file for complete search history.

(56) References Cited

U.S. PATENT DOCUMENTS

| | | | | |
|---|---|---|---|---|
| 3,848,106 | A | 11/1974 | Berggren et al. | |
| 5,003,152 | A * | 3/1991 | Matsuo et al. | 219/121.59 |
| 5,234,526 | A | 8/1993 | Chen et al. | |
| 5,302,803 | A * | 4/1994 | Stevens et al. | 219/121.43 |
| 5,793,334 | A * | 8/1998 | Anderson et al. | 343/786 |
| 5,834,744 | A | 11/1998 | Risman | |
| 6,087,642 | A * | 7/2000 | Joines et al. | 219/693 |
| 6,104,018 | A * | 8/2000 | Varma et al. | 219/746 |
| 6,673,198 | B1 * | 1/2004 | Wicker | 156/345.48 |

FOREIGN PATENT DOCUMENTS

| | | |
|---|---|---|
| EP | 0 838 637 | 4/2003 |
| JP | 8-106994 | 4/1996 |
| WO | WO 01/62379 A1 | 8/2001 |

OTHER PUBLICATIONS

International Search Report.
Office Action issued in corresponding Indian Patent Application No. 3458/CHENP/2005, dated Jan. 29, 2007.
Office Action for corresponding Japanese Application No. 532173/2006 dated Jun. 11, 2008.

* cited by examiner

*Primary Examiner*—Quang T Van
(74) *Attorney, Agent, or Firm*—Harness, Dickey & Pierce PLC

(57) ABSTRACT

A microwave heating device for heating load(s) and including a cylinder-shaped cavity enclosed by a periphery wall, the cavity is provided with a microwave feeding device. The heating device may have a dielectric wall structure arranged inside the cavity between the periphery wall and the load(s). The microwave feeding device may be arranged to generate a microwave field being an arch surface hybrid mode having TE and TM type properties inside the cavity to heat the load(s).

26 Claims, 3 Drawing Sheets

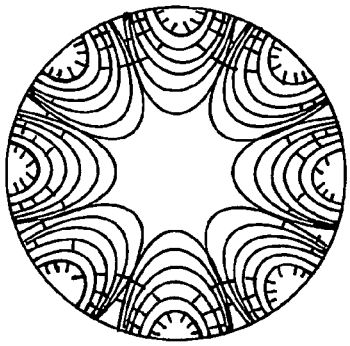
$TE_{41}$ FIG.1
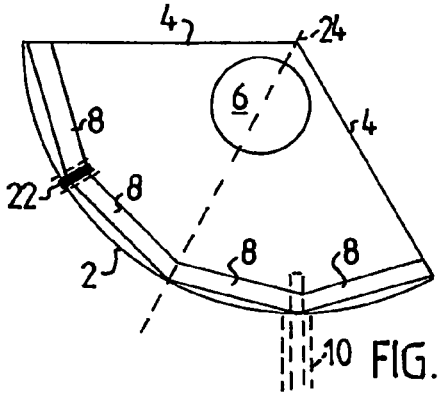
FIG.2
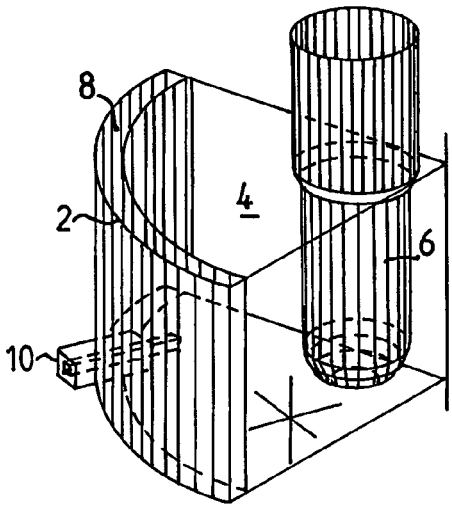
FIG. 3
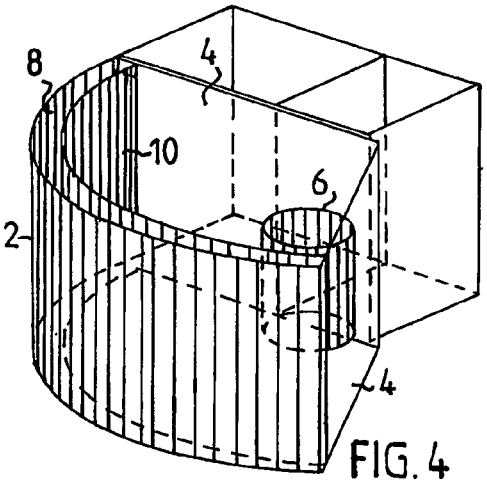
FIG. 4
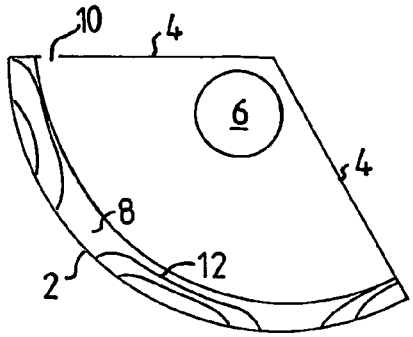
FIG.5

MICROWAVE HEATING DEVICE

FIELD OF THE INVENTION

The present invention relates to a microwave heating device, a microwave heating system and a method according to the preambles of the independent claims.

BACKGROUND OF THE INVENTION

Cavities and applicators for microwave heating of materials are typically resonant in operation, since such a condition results in possibilities of achieving a high microwave efficiency. Typical cavity/applicator loads have either a high permittivity such as 10 to 80 for polar liquids and compact food substances, or a lower permittivity but then also a low loss factor and a larger volume, such as in drying operations. In both these cases there is a need for the microwave energy to be reflected and retro-reflected many times in the cavity/applicator in order for a sufficient heating efficiency to be obtained. However, resonant conditions entails a limitation of the frequency bandwidth of proper function.

There are three methods in use to overcome the practical problem of limited resonance frequency bandwidth:

- Use of multiple resonances in a comparatively large cavity. At least one resonance will then exist at the operating frequency of the generator such as a magnetron. This type of cavity is easy to use but has the drawback of variable and quite unpredictable heating patterns and microwave efficiency for even slightly different loads, particularly if these are small.
- Use of some adjustment means for the resonant frequency in a single mode cavity/applicator. Mechanical means such as movable shorting plungers are cumbersome and require good galvanic contact. A more practical but still mechanically operated device is a non-contacting deflector described in WO-01/62379.
- Use of adjustable frequency generators.—Low power semiconductor generators or expensive TWT tubes may be useful, but another problem then occurs: that of the limits of the established ISM bands. For operating frequencies outside these, complicated shielding and filtering is needed.

If the required frequency variations are within for example the allowed 2400 to 2500 MHz, systems of the third kind above intended for a limited range of load geometries or permittivities may work well. The reduced resonance frequency span in use must then be inherently designed into the microwave applicator.

It may also be possible to achieve negative feedback of the applicator plus load resonant frequency by utilising a combination of applicator cavity and internal load resonant properties. Such systems are then limited to particular and rather narrow load geometries and dielectric properties, such as disclosed in U.S. Pat. No. 5,834,744.

SUMMARY OF THE INVENTION

An overall object of the present invention is to achieve a microwave heating device having a stable resonant frequency for a large variety of load geometries and permittivities, and also being less complex, more robust and less expensive than prior art arrangements.

This object is achieved by the present invention according to the independent claims.

Preferred embodiments are set forth in the dependent claims.

The present invention relates to a microwave enclosure which may be a partially open or closed resonant applicator incorporating a dielectric structure between a periphery wall and the load. The applicator is in principle mathematically cylindrical, which means that it has a defined longitudinal axis and a constant cross surface area (including that of the dielectric structure) along this axis. The type of mode in the applicator is essentially fieldless along a longitudinal axis in a central region of the applicator.

In typical single mode resonant applicators, the resonant frequency is reduced when a load is inserted, and if the load is not so large that it modifies the applicator mode pattern significantly, a higher load permittivity further lowers the resonant frequency. The device according to the present invention is essentially self-regulating by the mode being of a particular hybrid type. The mode can be said to consist of a TE part (with the axis as reference) and a TM part, the latter having an "inherent" higher resonant frequency and becoming stronger in relative terms when a load is inserted into the applicator, so that a compensation of the lowering of resonant TM mode frequency occurs.

The hybrid mode is of the HE type and have all six E and H orthogonal field components. It may exist in its basic form in a circularly cylindrical waveguide or cavity having a concentric dielectric at the periphery or further inwards. A TE mode with higher first (rotational, m) index than zero has this theoretically known property. However, the mode is to be fieldless at the longitudinal central axis in the present case, so the lowest first index is 2. Such applicators may be quite small, but applicators with first indices over 10 are also possible, resulting in a very wide application area for loads a fraction of a mL up to tens of L in volume, at 2450 MHz. An applicator for small loads may be basically closed and sector-shaped with a minimum sector angle of 360 m/4; in such cases an integer index is no longer needed. An applicator for large loads that are for example tube-shaped may be circular and open in central areas at the axis, for load insertion.

SHORT DESCRIPTION OF THE APPENDED DRAWINGS

FIG. 1 schematically illustrates the $TE_{41}$ mode.

FIG. 2 illustrates a cross-sectional view of a microwave heating device according to a first preferred embodiment.

FIG. 3 illustrates a variant of the first embodiment in a perspective view.

FIG. 4 illustrates an alternate feeding means applicable for the present invention in a perspective view.

FIG. 5 shows a cross-sectional view of a the device shown in FIG. 4.

Like numbers refer to like elements having the same or similar function throughout the description of the drawings.

DETAILED DESCRIPTION OF PREFERRED EMBODIMENTS OF THE INVENTION

Figure 6:
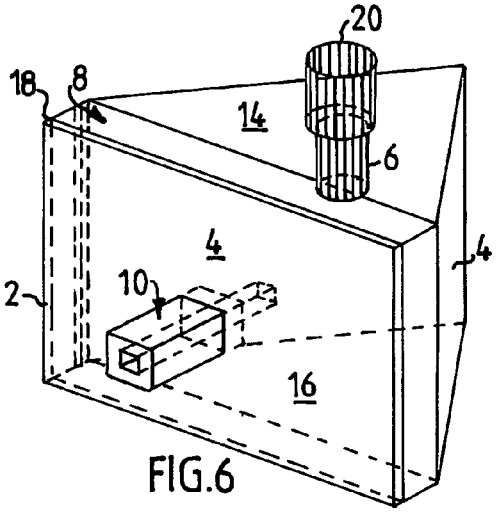
FIG. 6 shows in a perspective view a second preferred embodiment of the present invention.

The invention deals with and depends on certain properties of arch surface modes. Such modes can exist in cylindrical cavities with circular and elliptical cross sections, as well as with some polygonal cross sections. It has, however, been found that the deviations from smooth surfaces caused by the edges at corners may be unfavourable in some circumstances even with more than regular 12-sided polygonal cross sections.

Therefore, and since elliptical cross sections offer advantages only in some distinct cases, mainly circular cross sections—and in particular cross sections consisting of a circular sector—are dealt with here. More detailed extensions for non-circular peripheral geometries will follow later.

As a first illustrative example, the $TE_{41}$ mode is now dealt with (see FIG. 1). It has 8 maxima of the axial magnetic field (which is the dominating magnetic field direction) along the circular periphery of an empty waveguide or cavity. In the figure, the magnetic field is dashed and the electric field (which only exists in the plane perpendicular to the axis) is drawn as continuous lines.

An air filled empty $TE_{411}$ cavity is resonant at 2450 MHz when it has an axial length of 100 mm and is about 260 mm in diameter. Most of the energy is concentrated at the periphery, and can be described as two propagating waves along that, in opposite directions then setting up a standing wave pattern.

Arch surface modes can exist in confining geometries having a curved outer metal wall. In the simplest case, that of circularly cylindrical waveguides and resonators, they are defined by the axis being fieldless. Hence, in the common system of circular mode notation, the first (circumferential variation, defined to be in the $\phi$-direction) index is "high", the second (radial variation, defined to be the $\rho$-direction) index is "low", and the third, axial (defined to be the z direction) index is arbitrary.

The most common polarisation type for arch surface modes is TE, which means that there is no z-directed E field. Typically, there is a dominating z-directed magnetic field (and hence a $\phi$-directed wall current) at the curved metal surface. The first index must be at least 2.

For TM modes, there is no z-directed H field, and typically a dominating z-directed E field some distance away from the curved wall. The first index must also here be at least 2.

TE modes generally couple less efficiently to dielectric loads which are characterised by having a larger axial (circumferential, polygonal or circularly cylindrical) surface than its "top" and "bottom" (constant z plane) surfaces, since their E field is only horizontally directed and will therefore be perpendicular to any vertical load surface. They also have higher impedance than that of free space plane waves, which again results in a poorer coupling to dielectric loads which are inherently low impedance. One may simplify the situation by saying that there is no first-order coupling mechanism by TEz modes to loads with dominating z-directed dimensions. As a result, a higher quality factor (Q value) is needed for good power transfer to the load, but this entails a more narrow frequency bandwidth of the resonance needed for efficient heating of in particular small loads.

TM modes have z-directed E fields and are low impedance. They therefore couple significantly better to loads as above. However, that also means that loads which are not very small may influence the overall system properties, by for example causing a very significant resonant frequency change which offsets the advantage of a lower Q value (and by that the larger frequency bandwidth of the resonance).

A subgroup of the arch surface modes are the arch surface modes bound by a dielectric wall structure in the form of e.g. slabs, tiles or a plane or curved sheet.

The present invention is directed to this subgroup of arch surface modes, i.e. to microwave heating devices that include a closed cavity provided with a dielectric wall structure essentially located between a periphery wall of the cavity and one or many loads to be heated inside the cavity.

In circular (and also elliptical) cylindrical geometries it is then possible to introduce diametrical metal sidewalls in the axial direction, to create 8 independent cavities or waveguides. The smallest such sector-shaped cavity is 45° and is obtained with cut planes at 0° and 45° from e.g. the 6 o'clock direction in FIG. 1. The field properties (resonant frequency, etc.) do not change in such cases.

Such a sector waveguide can be considered to have a mode which becomes evanescent towards the edge (at the former axis). Hence, a load located close to this tip will be heated by some kind of evanescent coupling of the waveguide mode. It is then of great importance that the field impedance of the radially inwards-going evanescent mode is high and inductive. Since the load is supposed to have a significantly larger permittivity than air, the wave energy having reached the load is no longer evanescent.

A significant absorption can take place, provided the wave energy density has not fallen off "too much" at the load location. However a load located near the edge tip will couple very poorly.

Obviously, by locating a smaller load closer to the arched part of the cavity, the coupling will become stronger. It is also influenced by the load location in the angular direction, since the strength of in particular the magnetic field varies with location relative to the microwave feed or radial wall locations.

In the following is given an introduction of arch surface mode definitions and polarisations.

Microwaves may propagate along the boundary between two dielectrics, provided one of the regions has some losses (a so-called Zennek wave). Waves may also propagate without losses, along and bound to a lossless dielectric slab (a so-called dielectric-slab waveguide). A variant of the latter is that the dielectric has a metal backing on one side—as is the case for the present invention; the modes are then trapped surface waves.

The lossless propagation means that there is no radiation away from the system, in all the cases above—if there is no disturbing or absorbing object in the vicinity of the surface.

In U.S. Pat. No. 3,848,106 is disclosed a device that uses surface waves for microwave heating. The mode type is of the TM type, with the propagation in the direction (z) in the feeding $TE_{10}$ waveguide in essence having a dielectric slab filling being open to ambient in one broadside (a side). Hence, the mode field just outside the dielectric filling has no z-directed magnetic field but E fields in all directions. The mode used in the cavity according to the present invention is a hybrid mode that is defined herein as a mode where both E- and H-fields exist in the z-direction (being the longitudinal direction of the cavity.). In the hybrid mode the TE- and TM-modes exist and have radially directed H-fields. As an example: The hybrid mode $HE_{311}$ has all 6 components in a cavity provided with rotationally symmetrical dielectric structure.

Below is a theoretical reasoning regarding arch surface modes in circular waveguides and cavities.

As in any cylindrical empty metal tube of arbitrary cross section, there can be two distinct classes of modes in a circular waveguide: TE and TM to z. That means that one of the six E and H components must be missing. That is z-directed E and H, respectively.

It is of major importance for the invention that TM arch surface modes with the same three indices as TE modes have a higher resonant frequency in the same cavity (i.e. known diameter and length).

As an example, for the $TE_3/TM_3$ modes, the x'/x quotient is 4.42/6.38, to be inserted in the formula:

$$f_R = \frac{c_0}{2\pi a}\sqrt{x'^2_{mn} + \left(\frac{p\pi a}{h}\right)^2}$$

where $f_R$ is the resonant frequency, $c_0$ the speed of light, mnp the mode indices, a the cavity radius and h its height.

It is also important that all TE and TM modes in circular waveguides are orthogonal (except for the $TE_0$ and $TM_1$ series, which are, however, not arch surface modes). Hence, they cannot couple energy to each other.

When a circular waveguide has a concentric dielectric filling (ring-shaped along the periphery or a distance away from it, or a central rod), the modes no longer become TE or TM to any cylindrical co-ordinate, except for rotationally symmetric fields (arch surface modes are not that). This has been known since long as a theoretical curiosity.

With references to FIGS. 2 and 3 are given the basic designs and properties of a first preferred embodiment of the present invention.

It is to be understood that when the direction of reference is changed from a longitudinal in a rectangular system to the cylindrical system, the rectangular $TM_0$ mode becomes similar to the circular $TE_{m1}$ mode. Even if fully circular applicators are possible and may be feasible to design and use, a reduced geometry may be preferred for the purpose of heating of small loads. Not only is a smaller cavity obtained, but unwanted modes are also more easily avoided.

There are also other possible advantages by the particular current and field intensity distributions on flat metal axial cavity walls at an angle, with a dielectric wall structure along the curved sector periphery.

Thus, two variants of this first embodiment are shown in FIGS. 2 and 3, respectively. FIG. 2 shows a cross-sectional view in the xy plane, of a 120° sector applicator (or cavity) comprising a periphery wall 2, side walls 4, a load 6, a dielectric wall structure 8 and a microwave feeding means 10, where the dielectric wall structure comprises four flat dielectric tiles.

FIG. 3 illustrates in a perspective view a similar heating device but here with a dielectric-coated periphery wall 2. For both FIGS. 2 and 3: The dielectric wall structure is about 7 mm thick and has a typical permittivity of about 7.5. The loads are quite large (30 to 40 mm diameter) and the applicator radius is about 85 mm; the height is about 80 mm and the operating frequency is in the 2450 MHz ISM band.

It should be noted that when sector-shaped cavities are used, there is no longer a requirement on specified sector angles for obtaining resonances. Therefore, there is now a continuum of angles versus radius. Since analytical formulas involving integer order Bessel functions can be used for integer indices such as 3 and 4, direct calculations can be made, as above.

Also in the dielectric arch-trapped evanescent resonant cavity (applicator), the field patterns of the $TE_{311}$ mode dominate. That mode should not have any z-directed E component but the applicator mode has. This can be verified by microwave modelling, but the other components of the $TM_{311}$ mode (xy-plane H fields with maxima at the ceiling and floor, and xy-plane E fields with maxima at half height) are "hidden" since the $TE_{311}$ mode has those same components. In conclusion, the cavity mode is a hybrid $HE_{311}$ mode, where the cavity field intensities of the TE type are stronger than those of the TM type.

The advantage of having an essentially constant resonance frequency will be further discussed in the following.

It has been found by microwave modelling that the resonant frequency of an applicator as above varies exceptionally little with even very large load variations, such as from less than 1 mL in a small vial to over 50 mL in a container as in FIGS. 2 and 3. The loads are then polar liquids, also with highly variable permittivities and loss factors. Frequency variation may then be as low as within 1 MHz.

The cavity disclosed in FIGS. 6 and 7 was modelled and the result from the modelling is presented in table 1 (below).

The load had a diameter of 9 mm and 15 mm high cylinder (no glass vial), positioned with its top about 2 mm below the cavity ceiling. The antenna protrusion was quite small, in practice being in the same plane as the cavity wall (still with a hole in the ceramic block).

The ceramic permittivity was 7.5-j0.0125 throughout; this corresponds to a penetration depth of 4.2 m.

TABLE 1

| Load permittivity | Res. freq. MHz | Coupling factor | Q0 value (Prony) | Remarks |
|---|---|---|---|---|
| Empty | 2471 | 0.22 O | — | — |
| 10-j2 | 2466 | 0.17 O | — | Low-loss |
| 25-j6 | 2467 | 0.13 O | — | Standard |
| 78-j10 | 2465 | 0.16 U | — | Water at 20° C. |
| 60-j2 | 2466 | 0.14 O | — | Water at 100° C. |

O = overcoupled;
U = undercoupled.

Now different aspects of the microwave feeding means will be discussed. An interpretation of the function of the hybrid HE mode is that there is a balance between its TE and TM "parts" that changes with the loading. Dielectric loads that have a significant axial dimension typically couple more strongly to TM than TE modes and offsets the inherently higher resonant frequency tendency of the TM mode part.

As a consequence of this interpretation, it becomes important to use a feeding means which does not inherently influence the balance between the TE- and TM-type mode part relationships. Hence, if only the TE part is fed, the TM part can "freely" adapt to the variable load. Since the TM-type mode part lacks only one component—$H_z$—that becomes a preferred choice. This field component is strongest at the half height of the circular periphery; there are maxima at 0°, 60° and 120°. Hence, a vertical slot feed at 0° or 120° is feasible. The complementary E field to obtain a Poynting vector is then horizontal radial. The feed configuration is shown in FIG. 4; there is a normal $TE_{10}$ waveguide beside the cavity, with a vertical slot at the end.

The envelope of the Hz field in a very similar scenario, at half the cavity height, is shown in FIG. 5. The field pattern 12 in the dielectric wall structure resulting from the $TE_{31}$ mode part is schematically illustrated.

Another possibility is to excite the "rotational" Hz field at 30° (where it changes sign; there is no horizontal H field at half the cavity height) by a coaxial probe, and then at the same time obtain field matching to the horizontal radially inwards-going E field. That is shown in FIGS. 2 and 3.

Even if a desired function of reduced variation of the resonant frequency with different loads in principle occurs with a thin and low permittivity dielectric insert into the applicator, a preferred embodiment is that the dielectric material used in the dielectric wall structure (or cladding) should have such a high permittivity that a substantial part of the oscillating energy is bound to the periphery region. The only presumption for a HE mode to exist is that the permittivity (∈) is greater than 1. This results in a wide variety of combinations of the permittivity and the thickness of the dielectric wall structure. E.g. if ∈ is above 9, the (ceramic) cladding becomes rather thin, resulting in possible tolerance problems. For practical reasons the permittivity is preferably between 4 and 12. Between 6 and 9 seems to be the most desirable; the thickness is then between 8 and 6 mm.

For completeness it should be noted that the thickness of the dielectric wall structure is not related to the standard theory for common trapped surface waves which requires a thickness not greater that $$T = \frac{\lambda_0}{2\sqrt{\varepsilon - 1}}.$$

One design consideration is that it may be more difficult to metallise the outer surface of the ceramic than to leave an air distance between it and the cavity periphery. According to one embodiment of the present invention it has been found that a distance of 2 to 4 mm is feasible, in cases where a minimum distance is desirable for achieving a very small applicator.

The so far described applicators have a small distance between the tile and the outer metal wall of the applicator; the reasons for this are that a) metallization can then be avoided, and b) the mode field pattern is not influenced much (i.e. the mode remains of the TEm;1 type (not with higher second index than 1). This results in a conveniently small applicator. Applicators having a small distance between the periphery wall and the dielectric wall structure will be further described in connection with FIGS. 6-10.

There are several advantages by increasing the distance between the dielectric structure wall and the periphery wall.

One advantage is that there is then no need to arrange a hole in the dielectric wall structure for the microwave feeding means. This in turn makes it cheaper to manufacture the device.

Another advantage is that the near-field generated by the feeding means becomes more symmetrical.

These and other advantages will be further discussed in the following where references are made to the FIGS. 14 and 15.

When the distance between the dielectric wall structure and the periphery wall is increased to at least 15 mm, a second trapped surface wave occurs in that region and the axial magnetic field of the mode changes sign in the dielectric wall structure.

The mode then becomes of the same kind as the basic (now Cartesian/rectangular) TM-zero dielectric-slab type. If the applicator is circularly cylindrical, a number of standing (integer wavelengths) waves will occur circumferentilly, with the right dimensions.—Such an applicator will still retain the radial index 1 inwards (where the load(s) is/are), but may be easier to feed if very large (exceeding 300 mm or so at 2455 MHz, corresponding to circumferential index 10 or more (if 10, there are 20 standing wave maxima around the periphery). A particular advantage is that the feed needs not to be close to the tiles; near-field excitation resulting in risks of arcing or local overheating of the tile are drastically reduced in high power systems.

It has turned out that it is possible to use a larger distance (25 mm or more at 2450 MHz) between the inner surface of the periphery wall and the dielectric wall structure. One may then obtain two different field types in the dielectric structure—it is to be note that the mode reference is no longer to the whole cavity but instead only to the dielectric structure with wave energy propagating along in the circumferential cavity direction (to set up the cavity mode), and in rectangular notation. The two mode types are then dominantly $TM_0$ and $TM_1$. In the former case, there is no polarity change across the dielectric structure, and in the latter case there is one.

It turns out that the resulting cavity mode will have a lower first (the circumferential) index with the ceramic $TM_0$ field than with the ceramic $TM_1$ field, in spite of the radial index now being 2. That means that in this preferred case, the radial inwards evanescence will be slower and the mode behaviour also be less influenced by the load. The load is located close to the inner surface of the dielectric wall structure. Another important advantage is that the feeding means (between the dielectric structure and the periphery wall) can now be such that insignificant near-fields exist on the inner surface of the dielectric structure under conditions of normal high power transfer (i.e. impedance matching). In a preferred embodiment the feeding means is a common quarterwave radially directed coaxial metal antenna.

Arranging the dielectric structure at significant radial distance from the cavity periphery wall allows dual antenna constructions with a phase delay, resulting in an essentially unidirectional energy to flow inside the cavity in the circumferential direction. Several types of such antennas exist and can be used. Such antennas are typically easier to design and become smaller with the ceramic $TM_1$ mode than with the $TM_0$ mode, and since the circumferential mode index is higher in the former case, the distance between the minima which will occur due to imperfections of the system becomes smaller, which is advantageous.

The radial airspace between the periphery wall and the dielectric structure is up to half a free-space wavelength, which in a preferred embodiment is 20-30 mm. Either of the rectangular ceramic mode $TM_0$ or $TM_1$ is used, and $TM_0$ is typically preferred and is also what is obtained when the distance between the periphery wall and the dielectric structure is short.

Figure 14:
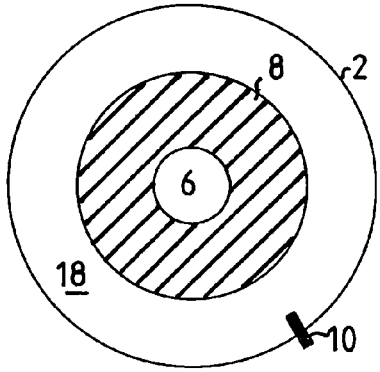
FIGS. 14 and 15 illustrate cross-sectional views of two embodiments according to the present invention of microwave heating devices provided with large radial airspaces.
Figure 15:
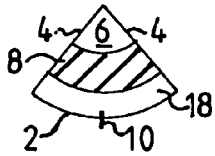

Thus, FIGS. 14 and 15 illustrates two embodiments of microwave heating devices provided with large radial airspaces according to the present invention.

FIG. 14 is a cross-sectional view of a circular cylindrical cavity including a periphery wall 2, an airspace 18 between the periphery wall and the dielectric wall structure 8 that encloses the load cavity 6. A feeding means 10 is arranged through the periphery wall.

FIG. 15 shows a cross-sectional view of a sector-shaped microwave heating device that in addition to the items of the embodiment in FIG. 14 includes two sidewalls 4.

Since the operating resonance frequency is essentially constant, it may be set to a suitable value in production trimming, by some means. It has been found preferable to include a small radial metal post 22 (see FIG. 2) positioned at the same location as the microwave feeding point but in the next half-wave position of the field (which has two halfwaves in FIG. 2 as drawn; that also applies to FIGS. 5 and 13). The metal post provides an about 50 MHz downwards adjustment of the resonant frequency in the 2450 MHz band, without any detrimental effects. The opening may have a diameter of 4 mm and the post is then less than 2 mm.

Since the hybrid mode is evanescent radially inwards, towards the "axis tip", there will be no or very weak fields there. In particular, since much of the energy coupling to the load is via the horizontal H fields and these are zero at the half height, quite large non-disturbing and non-radiating holes can be made in the radial cavity sides in that region.

A large load close to the "axis tip" will couple rather weakly (as desired) and not change the resonant frequency much. However, a small load in that same position may couple too weakly. If the very small load position is changed radially outwards along the dashed line 24 indicated in FIG. 2, the coupling will become stronger and the heating efficiency will increase. This allows an even larger latitude in load sizes and dielectric properties than with a fixed load position.

A practical simplification is to use flat tiles rather than a 120° (or so) curved one (as in FIGS. 3-5). It has been found that four such tiles as shown in the illustration in FIG. 2 is feasible. A smaller number will distort the delicate balance between the TE an TM mode parts of the hybrid mode in the cavity.

Microwave losses in the ceramic tiles cannot be avoided. As a matter of fact these ultimately determine how small loads can be heated efficiently. However, efficient heating of very small loads is difficult to control, due to the minute energy requirement. With "controlled" losses in the ceramic tiles, these can be said to be connected in electric parallel with the load and thus limit the "voltage". This results in a maximum heating intensity in the load when it absorbs the same power as the tiles (and also the cavity metal walls), and this intensity then falling off rather than remaining constant if the absorption capability of the load decreases further.

As expected, a typical system becomes overcoupled for small loads and undercoupled for large loads. The coupling can of course be changed so that critical coupling (and thus maximum efficiency) occurs for a suitably specified load.—It is then possible to further employ the non-linear properties of magnetrons, by choosing the mismatch phase (by the length of the feeding waveguide) such that operation is in the (higher efficiency) sink region with a large load, and in the (low efficiency but stable) thermal region for small loads. By such a design, the useful load range can be increased, and the risk of magnetron damage with a small load or empty be drastically reduced (the base loading of the ceramic tiles and by the cavity wall losses also contribute to the latter).

A second preferred embodiment of the present invention comprises a group of different variants that all fulfil the following design goals:

1) to provide an inexpensive small applicator, e.g. for only 1.0 mL liquid loads and the simplest possible system having no movable parts.
2) to facilitate dielectric property and self-heating testing of ceramic tiles with minimum machining.

As for the first preferred embodiment the cavity carries a dominating mode which is evanescent radially inwards towards the axis of a circular or sector-shaped cavity, in an airfilled region being either very small or at least trapezoid (triangular is preferred), so that resonances determined by the load itself and this workspace are deprecated.

There may be further ways of optimisation towards a still smaller resonant frequency difference for different load permittivities, by for example deviations by "bulges" from the straight flat ceramic slab sides.

Figure 7:
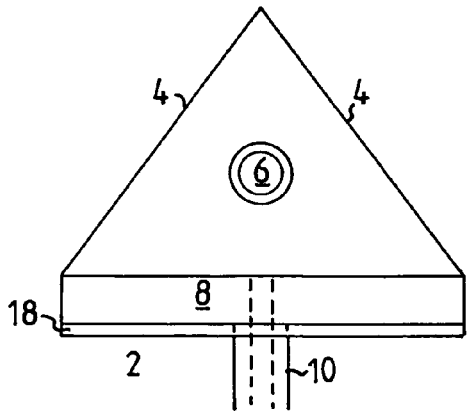
FIG. 7 shows the second preferred embodiment in a cross-sectional view.
Figure 8:
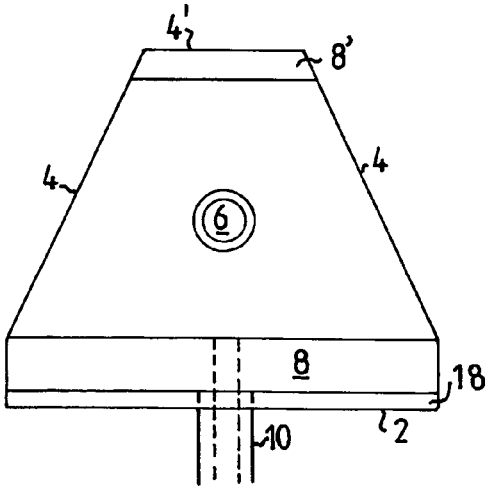
FIGS. 8 and 9 show cross-sectional views of variants of the second preferred embodiment.

FIGS. 6-9 illustrates different variants of the second preferred embodiment. The triangular applicator, as in FIG. 7, is basically just a distorted sector-shaped design for resonance of the mainly HE type hybrid arch surface mode. It has been found that the flat instead of arched ceramic does not give as good results with regard to frequency constancy for different loads, but results may be sufficient if load geometry or volume constraints are introduced.

By making the airspace trapezoids (see FIG. 8) by truncating the triangular cavity with a third side wall 4', the two resonances coincide, which is not so favourable but this variant may be improved by including a second dielectric wall structure 8' along the third side wall that essentially stabilises the field. This results in a more compact cavity.

Figure 9:
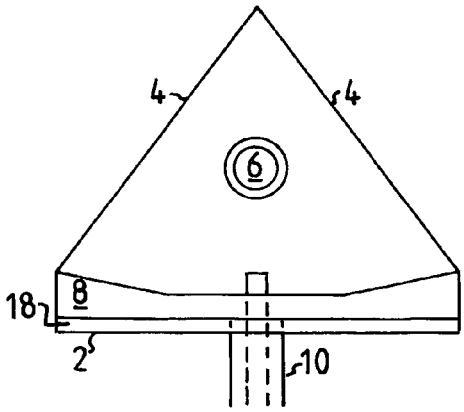

There is a possibility to compensate for a non-arched ceramic tile in single or multi-tile applicators, by making its cross section (horizontal, with the applicator axis considered vertical) with non-parallel sides. For practical manufacturing reasons, one side should then remain flat. This is shown in FIG. 9. The advantages are then that the behaviour becomes more like that with a truly arched tile (as shown in FIG. 2), i.e. better frequency constancy to variable loads.

The general geometry of the second preferred embodiment is that of a cylinder with triangular cross-section, containing a dielectric wall structure having a rectangular cross section the base side. The cavity feed is by a small, central coaxial antenna. The adaptation of resonant frequency to about 2455 MHz (in view of the not exactly known ceramic permittivity) is by changing the overall height. For that reason, the original height should be higher than anticipated for 2455 MHz resonance, so that it can more easily be changed.

The shape is shown in the FIGS. 6 and 7. The triangle above the ceramic has a base side of 80 mm and a height of 54 mm. The vertical cylinder height for about 2455 MHz resonance is about 61 mm, but the original height should be made 80 mm. The ceramic block has the horizontal sides 80 mm and 10 mm (=the thickness) and extends all their way in the vertical direction.

There is a 2 mm airgap 18 between the ceramic block and the parallel cavity wall behind. Hence, the cavity without ceramic consists of a triangular plus a rectangular part. The latter being 80×12 mm horizontally.

At the half height there is a centred coaxial feed with a corresponding hole through the ceramic. The hole is 8 mm in diameter.

There is a metal tube 20 (=wavetrap) with inner Ø 13 mm above the load, and height at least about 9 mm. The load axis and tube axis nominal positions are 32 mm from the applicator tip. Also illustrated in FIG. 6 is a top wall 14 and a bottom wall 16 that together with the side walls 4 and the dielectric wall structure make up the closed cavity. In FIGS. 6-9 the feeding means 10 is a coaxial probe.

Figure 10:
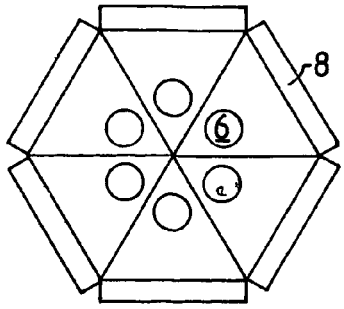
FIG. 10 shows in a cross-sectional view 6 microwave heating devices shown in FIG. 7 arranged together.

In FIG. 10 is shown a schematic and simplified set up of 6 microwave heating devices as the one illustrated in FIG. 7 arranged together. Please observe that no feeding means are included in the figure.

In an exemplary embodiment the cavity being a cylinder having a circular cross-section and is provided with one single feeding means that creates a single standing wave pattern within the cavity. This embodiment is primarily intended for heating multiple equal loads located symmetrically as illustrated in the schematic drawing in FIG. 11 that shows a cavity provided with 6 loads.

Figure 12:
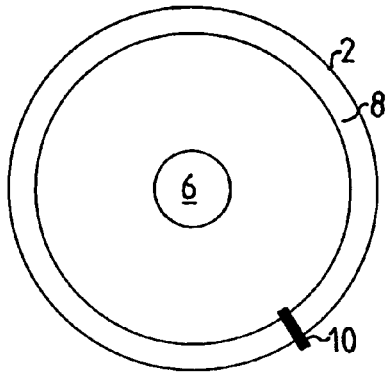

The standing wave pattern may be of the $HE_{6,1}$ mode and have one load at each field maximum, i.e. 12 loads, placed 30° apart or 6 loads (every second field maximum, i.e. 60° apart) or 4 loads (every third field maximum, i.e. 90° apart) or 3 loads (i.e. 120° apart) or 2 loads (i.e. 180° apart) or naturally one single load (schematically illustrated in FIG. 12).

Figure 11:
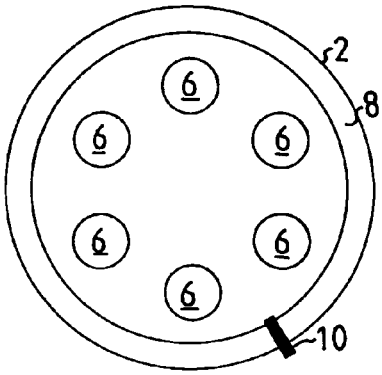
FIGS. 11 and 12 show cross-sectional views of different alternative embodiments of the present invention.

FIG. 11 shows a circular microwave heating device with dielectric wall structure 8 and a feeding means 10. The device may be in the $HE_{3;1;1}$ mode and there will then be 6 field periods, so that 6 equal loads 6 arranged in a circular fashion will be equally treated. Since the system resonance Q factor can be made as high as desired (due to the mode evanescence), there can actually be an extremely similar "impinging" field to all loads. It is now possible to choose the load locations in relation the positions of the standing magnetic and electric fields, so that the loads are treated by equivalent current or voltage sources, respectively.

If the loads are not equal, the result may be a negative or positive feedback of relative heating; for example by a hotter load of a number of otherwise equal loads being heated less, or for example by a larger load being heated more strongly—or vice versa, which is of course not desirable.

In a third preferred embodiment the cavity has a smaller size, and the periphery wall and the dielectric structure have circular cross-sections concentrically arranged with regard to each other. Naturally, this embodiment also covers variants where the periphery wall and the dielectric structure have a cross-section that is a part of a circle.

Figure 13:
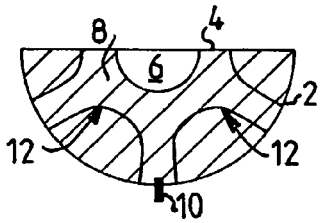
FIG. 13 shows a cross-sectional view of a third preferred embodiment of the present invention.

In a specific example the outer radius of the dielectric structure 8 (in FIG. 13) with a permittivity of 9 is 50 mm (which also is the radius of the inner surface of the periphery wall) and an opening 6 for the load with a radius of 20 mm. FIG. 13 illustrates the field pattern 12 in a semicircular cavity provided with feeding means 10 working at 2450 MHz at the lowest part in the figure. The field pattern will then have two whole and two half waves. As an alternative the centre angle may instead be 120° giving the same function. The height of the cavity is about 50 mm (e.g. 49 mm).

In this embodiment where the radial thickness of the dielectric wall structure (ceramic) is large and the arch-trapped evanescent resonance primarily takes place in the dielectric structure.

According to a fourth preferred embodiment of the present invention two hybrid modes, $HE_{m2;2;p}$ and $HE_{m1;1;p}$, with m2>m1, are used both being resonant at the same frequency.

The coupling factor from a simple radial feeding antenna will become different for the two modes, since the fields of the $HE_{m2;2;l}$ mode are more tightly bound to the dielectric and therefore couples less strongly then the $HE_{m1;1;l}$ mode which has a more constant field near the cavity periphery wall.

A cavity with a large load will get a lower quality factor (Q value), since stationary conditions occur after fewer retro reflections in the cavity. Therefore, there will always be a tendency for the coupling factor of a single mode cavity with a fixed antenna to go from undercoupling (the coupling factor<1) towards overcoupling (the coupling factor>1) when the load is reduced.

A design goal for a single mode resonant cavity for heating is therefore to set the coupling factor not to be too low for the largest (or most strongly absorbing) load, to be about 1 (critical coupling, resulting in impedance matching and thus maximum system efficiency) for the most typical load requiring high power, and not to be too high for the smallest (or weakly absorbing) load.

When two simultaneous modes are used to heat a load, one has to observe that these are almost always orthogonal. That means the power being transferred independently from the feed structure to the two modes, so that the power absorption will come from independent modes. However, since the modes have a common feed, their relative amplitudes (and by that their individual power transfer to the load) will depend on several factors such as the coupling impedances and feed to mode field matching. The resulting heating pattern will be a result of the vector summation of the two mode fields, since the situation is time-harmonic (the same single frequency is used).

Thus, according to the fourth embodiment the dynamic range of the system is extended by using the $HE_{m2;2;l}$ mode to heat small loads since its coupling factor for such loads is smaller than that of the $HE_{m1;1;l}$ mode—and by using the $HE_{m1;1;l}$ mode to heat larger loads since its coupling factor for such loads is larger than that of the $HE_{m;2;l}$ mode. The $HE_{m2;2;l}$ mode will be strongly undercoupled for large loads and thus not disturb the action of the $HE_{m1;1;l}$ mode. For small loads the $HE_{m1;1;l}$ mode will be overcoupled and may then disturb the action of the desired $HE_{m2;2;l}$ mode in that case.

Figure 16:
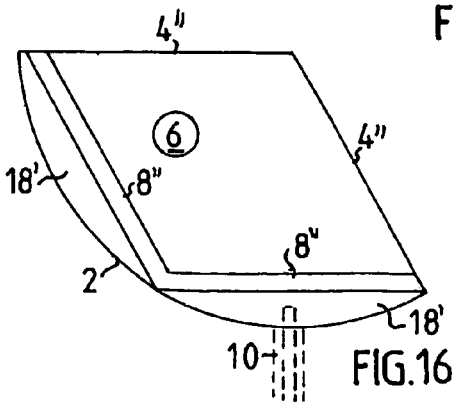
FIG. 16 shows a cross-sectional view of a fourth preferred embodiment of the present invention.

FIG. 16 illustrates a microwave heating device according to the fourth embodiment of the present invention. The device comprises a sector-shaped cavity comprising a periphery wall 2 and two sidewalls 4" that encloses the dielectric wall structure 8" and the load 6. The dielectric wall structure has the form of two equal, flat tiles that extend all the way from the bottom wall (not shown in FIG. 16) to the top wall (not shown in FIG. 16) of the cavity. The tiles are typically 10 mm thick, 80 mm high and have typically an $\in$ value of 8, the radius of the cavity is 85 mm and the sector angle is 120°.

One important feature of the fourth embodiment is that there is a significant radial distance between the curved periphery wall 2 and the dielectric wall structure 8" where air spaces 18' are formed. This is important since only then can two close resonant frequencies for modes of the $HE_{m1;1;p}$ and $HE_{m2;2;p}$ types easily be found and used.

As mentioned in relation with the embodiment shown in FIG. 2 a metal post (not shown in FIG. 16) may be used for fine-tuning of the resonant frequency of the $HE_{m1;1;p}$ mode. There may also be a need to fine-tune to zero difference between that resonance and that of the $HE_{m2;2;p}$ mode. This is achieved by moving the tiles inwards in the radial direction.

Also shown in FIG. 16 is a microwave feeding means 10, here in the form of a coaxial antenna. The insertion depth of the antenna is sensitive for the proper function of the microwave device. In the case illustrated in FIG. 16 the antenna insertion depth into the cavity is about 7 mm and its diameter is about 3 mm.

The frequency of both resonances is reduced somewhat with increased insertion depth—which of course also results in an increase of the coupling factor. In the shown illustration the load may have diameters ranging from 3 mm to 20 mm, and heights from 20 to 60 mm.

A number of data modelling of the system according to the fourth embodiment have been performed primary to investigate the frequency behaviour for different loads. This investigation confirms that a high efficiency is maintained under all conditions, with regard to the resonant frequency variability.

Thus, the dual hybrid arch surface mode cavity according to the fourth embodiment of the present invention provides a high heating efficiency for an exceptionally wide range of loads. The reason is that, with the same unchanged feeding means, the modes are interchangeably over- and under-coupled for large and small loads. This results in at least one of them couples well to almost any reasonable cavity load.

This extends the range of use to also small loads of about 0.1 mL (depending on the permittivity and how much overpowering is to be used). Such overpowering (perhaps up to 700 W input power) may be used with such small loads, since the cavity antenna is not located close to any ceramic tile which would otherwise cause field concentrations.

It has also turned out that the field pattern in the dual hybrid arch surface mode cavity has an improved coupling to some types of very small load geometries, in comparison with a single hybrid mode cavity.

The dual hybrid arch surface made cavity also provides possibilities for a quite even heating pattern in several load geometries—both large and small, and not necessarily in the shape of a vial. Examples of such extended use is heating of thin and horizontally flat loads, and use of a flow-through load application for processing of solid, semisolid or liquid loads in a type having a diameter up to 40 mm.

Figure 17:
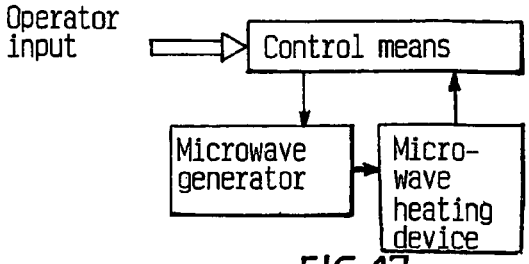
FIG. 17 shows a block diagram of a system for using the microwave heating device according to the present invention.

Finally, FIG. 17 shows a block diagram of a system for using the microwave heating device according to the present invention. An operator controls the system via a user interface (not shown) connected to a control means that inter alia controls the microwave generator with regard to e.g. the frequency and energy. The microwave generator applies the microwaves to microwave heating device via the microwave feeding means. The control means may also by provided with measurement input signals from the microwave heating device; these signals may represent e.g. the temperature and pressure of the load.

The present invention also relates to a method of heating loads in a microwave heating device or in a microwave heating system according to any above-mentioned embodiment. The method comprises the steps of arranging a load in the cavity and applying microwave energy at a predetermined frequency to the microwave heating device in order to heat the load(s).

Furthermore, the present also relates to the use of a microwave heating device or a microwave heating system according to any above-mentioned embodiment for chemical reactions and especially for organic chemical synthesis reactions, and also the use of the above method for chemical reactions and especially for organic chemical synthesis reactions.

The present invention is not limited to the above-described preferred embodiments. Various alternatives, modifications and equivalents may be used. Therefore, the above embodiments should not be taken as limiting the scope of the invention, which is defined by the appending claims.

The invention claimed is:

1. A microwave heating device for at least one heating load, the microwave heating device comprising:

a cylinder-shaped cavity enclosed by a periphery wall, said cavity including a microwave feeding device; and a dielectric wall structure arranged inside said cavity between said periphery wall and said at least one load, wherein said microwave feeding device is arranged to generate a microwave field being an arch surface hybrid mode having TE and TM type properties inside said cavity to heat the at least one load, wherein the feeding device includes a radially directed coaxial antenna and the microwave field is fed to the feeding device using an Hz component of the microwave field, wherein a thickness of the dielectric wall structure is dimensioned to balance between components of the hybrid mode in relation to a permittivity of the dielectric wall structure such that a substantial part of oscillating energy of the microwave filed is bound to a periphery region of the dielectric wall structure.

2. The microwave heating device according to claim 1, wherein said dielectric wall structure is in contact with an inner surface of the periphery wall.

3. The microwave heating device according to claim 1, wherein said dielectric wall structure covers the whole inner surface of the periphery wall.

4. The microwave heating device according to claim 1, wherein said dielectric wall structure is arranged a distance from the inner surface of the periphery wall.

5. The microwave heating device according to claim 1, wherein said dielectric wall structure comprises a number of tiles that essentially follow the shape of the periphery wall.

6. The microwave heating device according to claim 1, wherein said cavity comprises an upper wall and a lower wall.

7. The microwave heating device according to claim 1, wherein a metal post is arranged in an opening of the periphery wall for adjusting the resonant frequency.

8. The microwave heating device according to claim 1, wherein the load is adapted to be placed close to the centre of the cylinder-shaped cavity.

9. The microwave heating device according to claim 1, wherein the feeding device is a coaxial feeding device.

10. The microwave heating device according to claim 1, wherein for the hybrid mode the circumferential integer index m is less than 4, the radial index n=1 and the axial index p being an integer>0.

11. The microwave heating device according to claim 1, wherein said cavity has a circular cross section.

12. A microwave heating device for heating at least one load, the microwave heating device comprising:

a cylinder-shaped cavity having a periphery wall and two sidewalls attached to said periphery wall and to each other with an intermediate angle being less than 360°, the cavity having a microwave feeding device; and a dielectric wall structure arranged inside said cavity between said periphery wall and said at least one load, wherein said microwave feeding device is arranged to generate a microwave field being an arch surface hybrid mode having TE and TM type properties inside said cavity to heat the at least one load, wherein the feeding device is one of a slot along one of the two sidewalls and a radially directed coaxial antenna, and the microwave field is fed to the feeding device using an Hz component of the microwave field, wherein a thickness of the dielectric wall structure is dimensioned to balance between components of the hybrid mode in relation to a permittivity of the dielectric wall structure such that a substantial part of oscillating energy of the microwave filed is bound to a periphery region of the dielectric wall structure.

13. The microwave heating device according to claim 12, wherein said intermediate angle is 120°.

14. The microwave heating device according to claim 12, wherein said intermediate angle is 60°.

15. The microwave heating device according to claim 12, wherein said intermediate angle is 180°.

16. The microwave heating device according to claim 12, wherein said periphery wall has a curved shape.

17. The microwave heating device according to claim 12, wherein said periphery wall is a plane.

18. The microwave heating device according to claim 12, wherein for the hybrid mode the number of half waves inside the cavity is 1 or 2, the radial index n=1 or n=2 and the axial index p=1.

19. The microwave heating device according to claim 12, wherein said cavity has a cross section being a sector of a circle.

20. The microwave heating device according to claim 12, wherein said periphery wall has a cross section being a sector of a circle and that said dielectric wall structure being two equal, flat tiles, wherein two arch surface hybrid modes, $HE_{m2;2;p}$ and $HEmi_{;1;p}$ with m2<m1, are generated in said cavity, both hybrid modes being resonant at the same frequency.

21. The microwave heating device according to claim 20, wherein air spaces are formed between the flat tiles and the periphery wall.

22. A microwave heating system, comprising a plurality of the microwave heating device according to claim 12, wherein the plurality of microwave heating devices allow parallel handling and heating of loads.

23. The microwave heating device according to claim 12, further including a resonant applicator, the resonant applicator having a first index of 2 to 10.

24. The microwave heating device according to claim 12, wherein the thickness of the dielectric wall structure is about 7 mm.

25. The microwave heating device according to claim 12, wherein the permittivity of the dielectric wall structure is about 7.5.

26. A method of heating at least one load in a microwave heating device comprising:

providing at least one microwave heating device according to claim 12;

arranging the load in the cavity of the at least one microwave heating device; and applying microwave energy at a predetermined frequency to the microwave heating device to heat the at least one load.

* * * * *